US007712441B2

(12) United States Patent
Cinpinski et al.

(10) Patent No.: US 7,712,441 B2
(45) Date of Patent: May 11, 2010

(54) PREDICTED ENGINE OIL PRESSURE

(75) Inventors: Kenneth J. Cinpinski, Ray, MI (US); Byungho Lee, Ann Arbor, MI (US); Liyun Zheng, Troy, MI (US)

(73) Assignee: GM Global Technology Operations, Inc.

( * ) Notice: Subject to any disclaimer, the term of this patent is extended or adjusted under 35 U.S.C. 154(b) by 102 days.

(21) Appl. No.: 12/180,718

(22) Filed: Jul. 28, 2008

(65) Prior Publication Data

US 2009/0164087 A1 Jun. 25, 2009

Related U.S. Application Data

(60) Provisional application No. 61/015,358, filed on Dec. 20, 2007.

(51) Int. Cl.
*F01L 1/34* (2006.01)
*G01M 19/00* (2006.01)

(52) U.S. Cl. ..... 123/90.15; 73/114.57; 123/196 R

(58) Field of Classification Search ..... 123/90.15, 123/90.16, 90.17, 90.33, 90.34; 73/114.56, 73/114.57

See application file for complete search history.

(56) References Cited

U.S. PATENT DOCUMENTS

| | | | | |
|---|---|---|---|---|
| 5,247,914 | A * | 9/1993 | Imai et al. | 123/90.17 |
| 6,006,708 | A * | 12/1999 | Ken et al. | 123/90.17 |
| 6,196,174 | B1 * | 3/2001 | Wada et al. | 123/90.15 |
| 6,505,585 | B1 * | 1/2003 | Machida et al. | 123/90.17 |
| 6,656,089 | B2 * | 12/2003 | Furukawa | 477/111 |
| 6,758,176 | B2 * | 7/2004 | Wada et al. | 123/90.15 |
| 7,055,486 | B2 * | 6/2006 | Hoff et al. | 123/196 R |
| 7,584,728 | B2 * | 9/2009 | Berndorfer | 123/90.15 |
| 7,610,897 | B2 * | 11/2009 | Rayl | 123/321 |
| 2008/0000438 | A1 * | 1/2008 | Pierik | 123/90.12 |
| 2009/0064950 | A1 * | 3/2009 | Rayl | 123/90.15 |
| 2009/0311115 | A1 * | 12/2009 | Ono et al. | 417/279 |

* cited by examiner

*Primary Examiner*—Thomas N Moulis
(74) *Attorney, Agent, or Firm*—Harness, Dickey & Pierce, P.L.C.

(57) ABSTRACT

A control module may include a cam phaser control module, a cam phaser oil pressure determination module, and a system oil pressure prediction module. The cam phaser control module may control an oil control valve (OCV) to control an oil flow to a cam phaser. The cam phaser oil pressure determination module may be in communication with the cam phaser control module and may determine a first engine oil pressure at a location between the OCV and the cam phaser when the OCV is in a open position. The system oil pressure prediction module may determine a second engine oil pressure at a location between the OCV and an oil pump outlet based on the first engine oil pressure.

20 Claims, 4 Drawing Sheets

PREDICTED ENGINE OIL PRESSURE

CROSS-REFERENCE TO RELATED APPLICATIONS

This application claims the benefit of U.S. Provisional Application No. 61/015,358, filed on Dec. 20, 2007. The disclosure of the above application is incorporated herein by reference.

FIELD

The present disclosure relates to engine oil pressure prediction, and more specifically to engine oil supply pressure prediction based on a downstream oil pressure measurement.

BACKGROUND

The statements in this section merely provide background information related to the present disclosure and may not constitute prior art.

Engines typically include an oil supply pressure sensor to monitor oil pressure supplied to a lubricated portion of the engine, such as the main bearings. With additional hydraulically actuated components such as cam phasers and multi-step lifters being incorporated into engines, additional oil pressure sensors may be needed at locations downstream of an oil supply pressure sensor. Additional oil pressure sensors may add additional cost and complexity to engines.

SUMMARY

A method may include opening an oil control valve (OCV) in an engine to provide an oil flow that actuates a cam phaser, measuring a first engine oil pressure at a location between the OCV and the cam phaser when the OCV is open, and determining a second engine oil pressure at a location between the OCV and an oil pump outlet location based on said first engine oil pressure.

A control module may include a cam phaser control module, a cam phaser oil pressure determination module, and a system oil pressure prediction module. The cam phaser control module may control an oil control valve (OCV) to control an oil flow to a cam phaser. The cam phaser oil pressure determination module may be in communication with the cam phaser control module and may determine a first engine oil pressure at a location between the OCV and the cam phaser when the OCV is in an open position. The system oil pressure prediction module may determine a second engine oil pressure at a location between the OCV and an oil pump outlet based on the first engine oil pressure.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
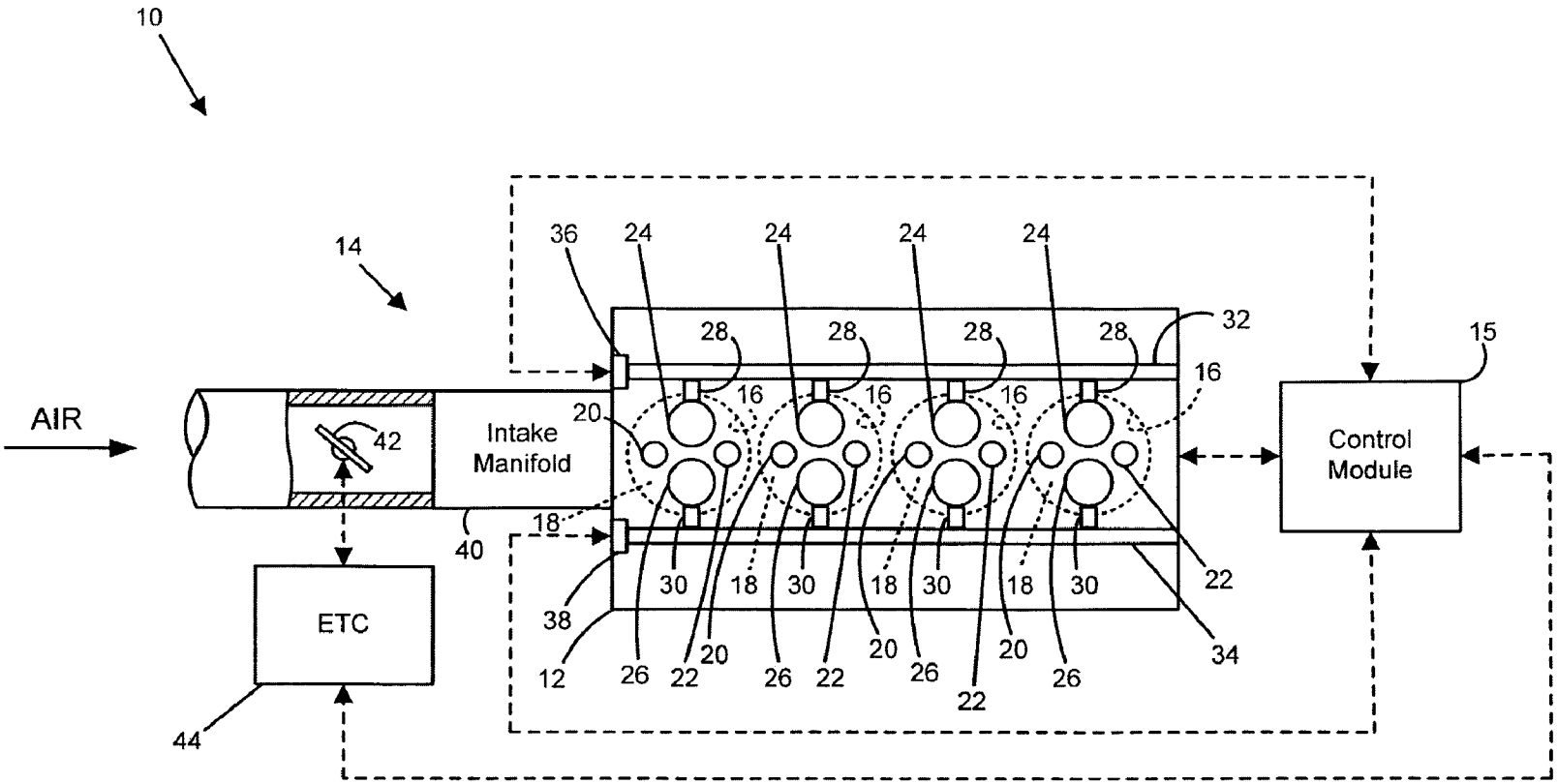
FIG. 1 is a schematic illustration of a vehicle according to the present disclosure.

The following description is merely exemplary in nature and is not intended to limit the present disclosure, application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, or other suitable components that provide the described functionality.

Referring now to FIG. 1, an exemplary vehicle 10 is schematically illustrated. Vehicle 10 may include an engine 12 in communication with an intake system 14 and a control module 15. Engine 12 may include a plurality of cylinders 16 having pistons 18 disposed therein. Engine 12 may further include a fuel injector 20, a spark plug 22, an intake valve 24, an exhaust valve 26, an intake valve lifter 28, and an exhaust valve lifter 30 for each cylinder 16, as well as intake and exhaust camshafts 32, 34, and intake and exhaust cam phaser systems 36, 38.

Intake system 14 may include an intake manifold 40 and a throttle 42 in communication with an electronic throttle control (ETC) 44. Throttle 42 and intake valves 24 may control an air flow into engine 12. Fuel injector 20 may control a fuel flow into engine 12 and spark plug 22 may ignite the air/fuel mixture provided to engine 12 by intake system 14 and fuel injector 20. Intake and/or exhaust valve lifters 28, 30 may include multi-step lifters, such as two-step lifters.

Figure 2:
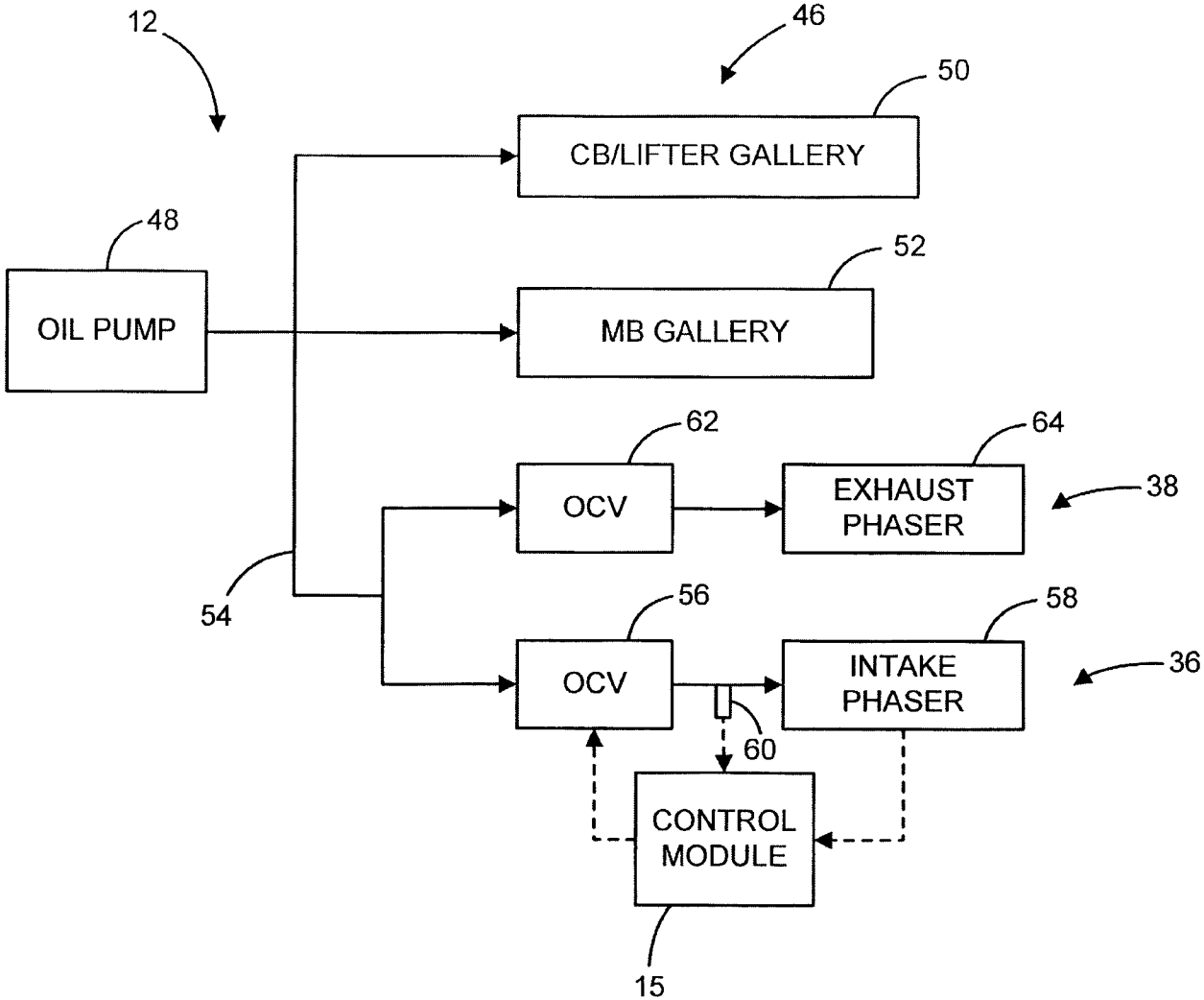
FIG. 2 is a schematic illustration of an engine oil system of the vehicle of FIG. 1.

With additional reference to FIG. 2, engine 12 may include an oil system 46 that includes an oil pump 48, a cam bearing and lifter gallery 50, a main bearing gallery 52, and a cam phaser oil feed 54 in fluid communication with the intake and exhaust cam phaser systems 36, 38. Intake cam phaser system 36 may include an oil control valve (OCV) 56, a cam phaser 58, and a pressure sensor 60 located between OCV 56 and cam phaser 58. Pressure sensor 60 may be in communication with control module 15 and may provide a signal to control module 15 indicative of an oil pressure between OCV 56 and cam phaser 58. Exhaust cam phaser system 38 may include an OCV 62 and a cam phaser 64. While oil pressure sensor 60 is shown located between OCV 56 and cam phaser 58, it is understood that oil pressure sensor 60 may alternatively be located between OCV 62 and cam phaser 64.

Figure 3:
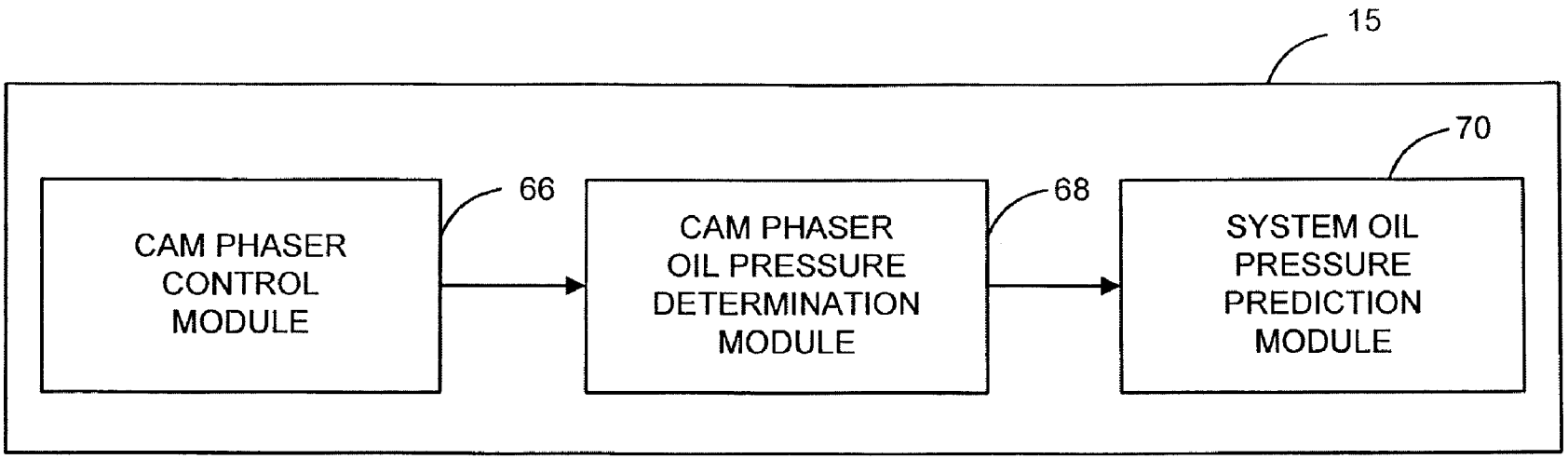
FIG. 3 is a control block diagram of the control module shown in FIG. 1.

Control module 15 may be in communication with engine 12 and may receive a signal from engine 12 indicative of a current engine speed. Control module 15 may additionally be in communication with intake and exhaust cam phaser systems 36, 38 and ETC 40. More specifically, in the present example control module 15 may be in communication with OCV 56 and intake phaser 58 to control opening of OCV 56 and to determine phasing rate and location of cam phaser 58. With reference to FIG. 3, control module 15 may include a cam phaser control module 66, a cam phaser oil pressure determination module 68, and a system oil pressure prediction module 70.

Cam phaser control module 66 may control the opening of OCV 56 and therefore the phasing rate and displacement of cam phaser 58. Cam phaser oil pressure determination module 68 may be in communication with and receive a signal from cam phaser control module 66 that indicates a position of OCV 56 and a phasing rate of cam phaser 58. Cam phaser oil pressure determination module 68 may determine the oil pressure at a location between OCV 56 and cam phaser 58. The determined oil pressure may be used for evaluation of the intake and/or exhaust valve lifters 28, 30 when multi-step lifters are incorporated into engine 12. The determined oil pressure may additionally be used to estimate or predict an oil supply pressure. The oil supply pressure may include an oil pressure at a location in oil system 46 between oil pump 48 and OCV 56, and more specifically an oil pressure at main bearing gallery 52.

System oil pressure prediction module 70 may be in communication with cam phaser oil pressure determination module 68 and may receive the determined oil pressure. System oil pressure prediction module 70 may estimate a system oil flow rate and predict the oil supply pressure.

Figure 4:
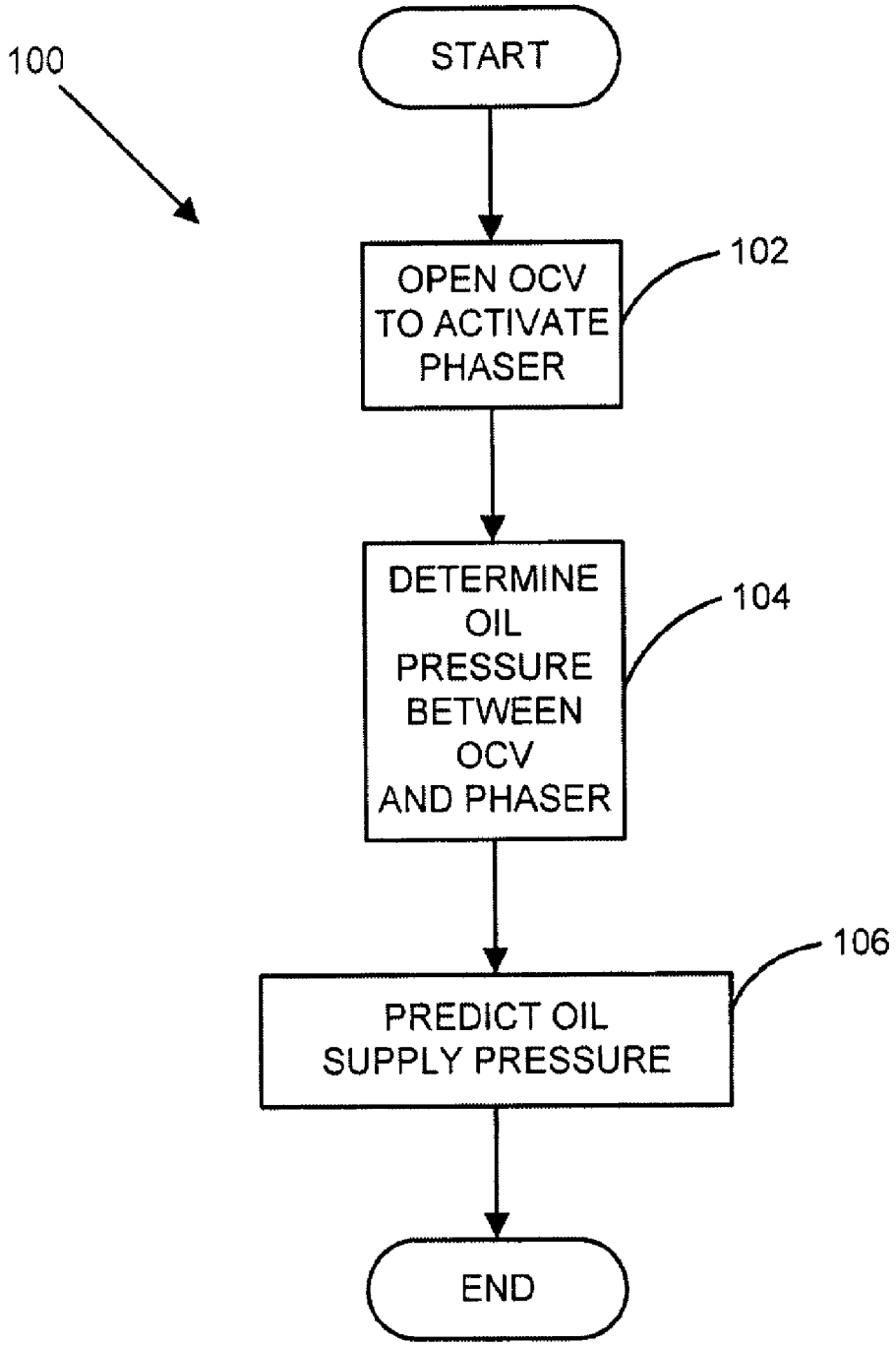
FIG. 4 is a flow diagram illustrating steps for oil pressure prediction for the vehicle of FIG. 1.

With reference to FIG. 4, control logic 100 generally illustrates a method of predicting the oil supply pressure discussed above. Control logic 100 may begin at block 102 where OCV 56 is opened to actuate cam phaser 58. Control logic 100 may then proceed to block 104 where oil pressure ($P_d$) is determined at a location between OCV 56 and cam phaser 58 using pressure sensor 60 while OCV 56 is open. Control logic 100 may then proceed to block 106 where the oil supply pressure ($P_s$) is predicted. Control logic 100 may terminate once the oil supply pressure is determined.

Prediction of the oil supply pressure ($P_s$) using the determined oil pressure ($P_d$) may include a calculation of the oil supply pressure based on the following equations:

$$P_s = P_d + \frac{\dot{V}^2\rho}{2C_d^2A_d^2}\left(1-\left(\frac{A_s}{A_d}\right)^2\right) + g\rho h; \tag{1}$$

and $$C_d = f(\dot{V}, \rho, \nu); \tag{2}$$

where $P_s$ is the oil supply pressure, $P_d$ is the determined oil pressure (a downstream oil pressure between OCV 56 and cam phaser 58 in the present example), $\dot{V}$ is an estimated system volumetric oil flow rate, $\rho$ is oil density, $\nu$ is oil viscosity, $C_d$ is a discharge coefficient, $A_s$ is a supply side reference area, $A_d$ is a downstream side reference area, g is the gravitational constant (9.81 m/s$^2$), and h is the height of the location of $P_d$ relative to $P_s$.

A matrix of discharge coefficients ($C_d$) may be determined for a variety of engine operating conditions. The discharge coefficients ($C_d$) may be determined from component level testing and may be a function of volumetric oil flow rate ($\dot{V}$), oil density ($\rho$), and oil viscosity ($\nu$), as shown in equation (2) above. More specifically, the discharge coefficients ($C_d$) may be calculated based on the component level testing.

For example, a known volumetric oil flow rate ($\dot{V}$) may be supplied to the engine 12 at a location corresponding to an oil pump outlet. A range of volumetric oil flow rates ($\dot{V}_1$, $\dot{V}_2, \ldots, \dot{V}_n$) may be supplied for a variety of engine conditions including oil temperatures (which accounts for oil density ($\rho$) and oil viscosity ($\nu$)) as well operating conditions of cam phasers 58, 64. A first oil pressure measurement (P1) that generally corresponds to determined oil pressure ($P_d$) may be taken at pressure sensor 60 and a second oil pressure measurement (P2) that generally corresponds to oil supply pressure ($P_s$) may be taken upstream of first oil pressure measurement (P1). For example, second oil pressure measurement (P2) may be taken at main bearing gallery 52. A range of first oil pressures ($P1_1$, $P1_2$, . . . , $P1_n$) and second oil pressures ($P2_1$, $P2_2$, . . . , $P2_n$) may be collected that correspond to the range of volumetric oil flow rates ($\dot{V}_1$, $\dot{V}_2$, . . . , $\dot{V}_n$).

Equation (1) may be manipulated to solve for discharge coefficient ($C_d$) using the first and second oil pressure measurements (P1, P2) as seen below in equation (3):

$$C_d = \frac{\dot{V}}{\left(A_d\sqrt{\dfrac{\frac{2}{\rho}(P2-P1)-2gh}{1-\left(\frac{A_d}{A_s}\right)^2}}\right)} \tag{3}$$

A range of discharge coefficients ($C_{d1}$, $C_{d2}$, . . . , $C_{dn}$) may be calculated that correspond to the range of volumetric oil flow rates ($\dot{V}_1$, $\dot{V}_2$, . . . , $\dot{V}_n$) first oil pressures ($P1_1$, $P1_2$, . . . , $P1_n$) and second oil pressures ($P2_1$, $P2_2$, . . . , $P2_n$). Supply and discharge side reference areas ($A_s$, $A_d$) may be selected, where $A_s$ is not equal to $A_d$. Supply and discharge side reference areas ($A_s$, $A_d$) may be selected in a relatively arbitrary manner, as long as the same supply and discharge side reference areas ($A_s$, $A_d$) are used for the calculation of each of discharge coefficients ($C_{d1}$, $C_{d2}$, . . . , $C_{dn}$) and for the calculation of the supply pressure ($P_s$).

The range of discharge coefficients ($C_{d1}$, $C_{d2}$, . . . , $C_{dn}$) may form a matrix of discharge coefficients for use in the calculation of the supply pressure ($P_s$). The values for the range of discharge coefficients may form a regression-based function or may be incorporated into a look-up table. Therefore, based on estimated system oil flow rate ($\dot{V}$), the supply pressure ($P_s$) may be predicted based on the determined oil pressure ($P_d$) from pressure sensor 60.

Alternatively, oil supply pressure ($P_s$) may be determined from a purely empirical regression equation shown in equation (4) below:

$$P_s = f(P_d, \mathrm{RPM}, T, \dot{\phi}_I, \dot{\phi}_E); \tag{4}$$

where $P_d$ is the determined oil pressure, as discussed above, RPM is engine speed (revolutions/minute), T is oil temperature, $\dot{\phi}_I$ is intake phaser phasing rate, and $\dot{\phi}_E$ is exhaust phaser phasing rate. Equation (4) may be derived experimentally from engine testing. Engine speed (RPM) may be used where oil pump 48 is driven by a mechanical component of engine 12 such as the crankshaft. Engine speed (RPM) may be disregarded where oil pump 48 is driven independently from engine 12, such as by an electric motor.

In either oil supply pressure ($P_s$) determination method, pressure sensor 60 may generally provide for the estimation of a system supply pressure, eliminating the need for an additional oil pressure sensor.

What is claimed is:

1. A method comprising:

opening an oil control valve (OCV) in an engine to provide an oil flow that actuates a cam phaser;

measuring a first engine oil pressure at a location between said OCV and said cam phaser when said OCV is open; and determining a second engine oil pressure at a location between said OCV and an oil pump outlet location based on said first engine oil pressure.

2. The method of claim 1, wherein said opening said OCV includes opening said OCV to a fully open position.

3. The method of claim 1, wherein said second engine oil pressure is indicative of a bearing supply pressure.

4. The method of claim 1, wherein said determining is based on a predetermined system oil flow restriction between said first and second engine oil pressure locations.

5. The method of claim 4, wherein said predetermined system oil flow restriction is based on a discharge coefficient.

6. The method of claim 5, wherein said discharge coefficient is empirically derived.

7. The method of claim 5, further comprising determining an estimated system oil flow rate, said determined second engine oil pressure being a function of said first engine oil pressure, said discharge coefficient, and said estimated oil flow rate.

8. The method of claim 7, wherein said discharge coefficient is a function of said estimated engine oil flow rate.

9. The method of claim 7, wherein said determining said second engine oil pressure includes determining a ratio between said estimated system oil flow rate and said discharge coefficient.

10. The method of claim 1, wherein said determining includes determining said second engine oil pressure based on a regression-based function.

11. A control module comprising:

a cam phaser control module that controls an oil control valve (OCV) to control an oil flow to a cam phaser;

a cam phaser oil pressure determination module in communication with said cam phaser control module that determines a first engine oil pressure at a location between said OCV and said cam phaser when said OCV is in an open position; and a system oil pressure prediction module in communication with said cam phaser oil pressure determination module that determines a second engine oil pressure at a location between said OCV and an oil pump outlet based on said first engine oil pressure.

12. The control module of claim 11, wherein said cam phaser oil pressure determination module determines said first engine oil pressure when said cam phaser control module opens said OCV.

13. The control module of claim 11, wherein said second engine oil pressure is indicative of a bearing supply pressure.

14. The control module of claim 11, wherein said system oil pressure prediction module determines said second engine oil pressure based on a predetermined system oil flow restriction between said first and second engine oil pressure locations.

15. The control module of claim 14, wherein said predetermined system oil flow restriction is based on a discharge coefficient.

16. The control module of claim 15, wherein said discharge coefficient is empirically derived.

17. The control module of claim 15, wherein said system oil pressure prediction module determines an estimated engine oil flow rate, said determined second engine oil pressure being a function of said first engine oil pressure, said discharge coefficient, and said estimated oil flow rate.

18. The control module of claim 17, wherein said discharge coefficient is a function of said estimated engine oil flow rate.

19. The control module of claim 17, wherein said determined second engine oil pressure is based on a ratio between said estimated engine oil flow rate and said discharge coefficient.

20. The control module of claim 11, wherein said system oil pressure prediction module determines said second engine oil pressure based on a regression-based function.

* * * * *